US006776734B2

(12) United States Patent
van Nimwegen

(10) Patent No.: US 6,776,734 B2
(45) Date of Patent: Aug. 17, 2004

(54) GROUND-ANCHORED BASE FOR A PORTABLE BASKETBALL GOAL ASSEMBLY

(75) Inventor: Edward G. van Nimwegen, North Ogden, UT (US)

(73) Assignee: Lifetime Products, Inc., Clearfield, UT (US)

( * ) Notice: Subject to any disclaimer, the term of this patent is extended or adjusted under 35 U.S.C. 154(b) by 0 days.

(21) Appl. No.: 10/052,164

(22) Filed: Jan. 17, 2002

(65) Prior Publication Data

US 2003/0092514 A1 May 15, 2003

Related U.S. Application Data

(60) Provisional application No. 60/263,001, filed on Jan. 19, 2001.

(51) Int. Cl.[7] ..... A63B 63/08

(52) U.S. Cl. ..... 473/481; 248/346.2

(58) Field of Search ..... 473/479, 480–485; D21/703; 273/317.3; 248/346.2, 650, 188; 70/58, 98; 52/704, 707, 157, DIG. 11; 256/65.14

(56) References Cited

U.S. PATENT DOCUMENTS 3,517,470 A * 6/1970 Luebkeman ..... 52/157
4,526,367 A * 7/1985 Haston et al. ..... 473/483
4,611,812 A * 9/1986 Morrison ..... 473/485
5,102,128 A * 4/1992 Geise ..... 473/483
5,259,612 A * 11/1993 Matherne et al. ..... 473/484
5,568,711 A * 10/1996 Popp et al. ..... 52/704
5,902,197 A * 5/1999 Davis et al. ..... 473/479
5,983,602 A * 11/1999 Allen et al. ..... 53/445

OTHER PUBLICATIONS

Huffy Sports web page for Quick Clip Basketball System, 2 pages, Nov. 26, 2001.

Assembly Instructions and Owner's Manual for Lifetime products "Poolside Basketball System," Nov. 3, 2000, 12 pages.

* cited by examiner

*Primary Examiner*—Stephen P. Garbe
*Assistant Examiner*—M. Chambers
(74) *Attorney, Agent, or Firm*—Workman Nydegger

(57) ABSTRACT

An anchoring assembly for a portable basketball goal assembly is disclosed. The anchoring assembly enables the basketball goal assembly to be rigidly attached to a playing surface to stabilize the basketball goal assembly during game play. Each anchoring assembly may include an anchor fitted within an anchoring hole of the playing surface and an anchoring attachment extending through a hole in the base of the basketball goal assembly to engage the anchor. The anchoring attachment can be gripped and rotated by a user to engage or disengage the anchoring assembly. Various bracket arrangements may be used in conjunction with oversized holes in the base to permit significant variation in the positioning and orientation of the anchoring holes. Furthermore, support struts may be attached directly to such brackets to transmit force through a pathway constructed exclusively of high strength material.

37 Claims, 6 Drawing Sheets

GROUND-ANCHORED BASE FOR A PORTABLE BASKETBALL GOAL ASSEMBLY

RELATED APPLICATIONS

This application claims the benefit of U.S. Provisional application Ser. No. 60/263,001 filed Jan. 19, 2001 and entitled GROUND-ANCHORED BASE FOR A PORTABLE BASKETBALL GOAL ASSEMBLY, which is incorporated herein by reference.

BACKGROUND OF THE INVENTION

1. The Field of the Invention

The present invention relates to basketball goal assemblies. More specifically, the present invention relates to systems and methods for anchoring a portable basketball goal assembly with respect to a playing surface.

2. The Relevant Technology

Basketball is an increasingly popular sport in the United States and abroad. There are many cities, counties and other associations that sponsor recreational and instruction leagues where people of all ages can participate in the sport of basketball. Today there are organized leagues for children as young as five and six years old. Accordingly, is not surprising that more and more people have a basketball goal assembly mounted on their own property.

Known freestanding basketball goal assemblies for home use typically have a standardized backboard and rim attached to a support pole. The pole is typically affixed to some type of base with a comparatively large footprint to provide stability to the basketball goal assembly. The base may extend rearward from the pole.

The rim of the basketball goal assembly is typically disposed about ten feet above the playing surface, and a few feet forward of the front of the base. The "moment," or force tending to turn an object around an axis, is generally equal to the magnitude of the force multiplied by the length of the moment arm. Because the moment arms involved in use of a basketball assembly are so long, game play exerts a large moment on the basketball goal assembly that must be counteracted by the weight of the base. For example, a person hanging on the rim, as when performing a dunking maneuver, produces a moment equivalent to their weight multiplied by the horizontal offset between the rim and the front edge of the base. Similarly, when a ball bounces horizontally off of the backboard, the resulting moment is generally the impact force of the ball against the backboard multiplied by the vertical offset of the backboard from the base.

In response to these large moments, heavier and larger bases have been created in an effort to keep the goal steady. Often, these bases are heavily weighted and require a considerable amount of space, thereby cutting into the paved area that can be used for play. Despite their weight and size, known base arrangements are often insufficient to keep the basketball goal assembly steady during play. Even an inch of motion of the backboard can make game play somewhat unpredictable.

Some known systems also provide a tethering arrangement configured to keep the base in place. These tethering arrangements typically provide some type of flexible attachment, such as a chain or rope, to tether the base to the playing surface. Although such arrangements can keep the base from sliding significantly in a horizontal direction, they typically cannot be tensioned greatly enough by a user to prevent vertical motion in the base. Thus, such tethering arrangements are typically insufficient for steadying the goal assembly during play.

Accordingly, a need exists for a system and method for steadying the base of a basketball goal assembly. Preferably, the system and method should provide some type of rigid attachment to the playing surface so that the goal assembly is unable to move during play. The system and method should preferably not produce large stresses in the base, so that lightweight, inexpensive, and comparatively low-strength materials can be used to form the base. The system and method is preferably operable by a user with a minimum of hand tools and effort. Additionally, the system as a whole is preferably inexpensive and easy to manufacture.

OBJECTS AND BRIEF SUMMARY OF THE INVENTION

The apparatus of the present invention has been developed in response to the present state of the art, and in particular, in response to the problems and needs in the art that have not yet been fully solved by currently available basketball goal assemblies. Thus, it is an overall objective of the present invention to provide a basketball goal assembly that can easily be anchored to a playing surface.

To achieve the foregoing objects, and in accordance with the invention as embodied and broadly described herein in the preferred embodiment, a novel anchoring assembly for a basketball goal assembly is provided. The anchoring assembly may comprise an anchoring attachment, which may take the form of a threaded fastener. Preferably, the anchoring attachment has a head configured to be gripped and turned by a user without the aid of hand tools. The anchoring attachment may be twisted into place within an anchor positioned within an anchoring hole formed in the playing surface, underneath the base.

The anchor may comprise a metallic tube configured to expand when the anchoring attachment is inserted so that the anchor engages the sides of the anchoring hole. The anchor may have a threaded inside diameter, configured to receive the anchoring attachment in threaded engagement. The anchor may also simply be made of a softer material than that of the anchoring fastener so that insertion of the anchoring attachment into the anchor deforms the inside diameter of the anchor to form threads therein. The anchor may have ridges or other features disposed about its outside diameter to engage the walls of the anchoring hole when the anchor expands due to the outward pressure of the anchoring attachment.

The anchoring attachment is preferably threaded through a hole formed in a mounting region of the base. A support strut may advantageously be affixed to the same mounting region and to the support pole to keep the support pole vertical. Thus, moment forces acting on the backboard and rim are transmitted through the pole and into the base via the support struts. Positioning the anchoring attachment near the attachment of the support strut ensures that the moment arm of those forces with respect to the anchoring assembly is small. This reduces the likelihood of bending in the anchoring attachment or the base material through which the anchoring attachment is threaded.

In certain embodiments, two or more such anchoring assemblies may be used. For example, a basketball goal assembly may have two support struts, symmetrically positioned to support the support pole. One anchoring assembly may be positioned near the attachment of each support strut to the base.

If desired, such an anchoring assembly may also have a resilient member, such as a spring, positioned to urge the anchoring attachment upward, away from the anchor. For example, a linear spring may be positioned between the base and the head of the anchoring attachment so that the linear spring is compressed when the anchoring attachment is engaged within the anchor. Then, when the anchoring attachment is unscrewed, the force of the spring keeps it upward, away from the anchoring hole. Thus, the base may be moved horizontally, for example, to store the basketball goal assembly for the winter, without dragging the anchoring attachment against the playing surface.

Additionally, a plug may be provided to cover the anchoring hole while the basketball goal assembly is not anchored. The plug may keep moisture and debris out of the hole to prevent obstruction or damage from ice expansion. Such a plug may be constructed of a plastic material, and may have a head and a threaded portion so that a user can grasp the head and twist the plug into place within the anchoring hole. Thus, the portable basketball goal assembly may be rigidly anchored into place for game play, and moved or stored as desired by disengaging the anchoring assemblies.

According to some alternative embodiments, anchoring assemblies may be configured to permit significant variation in the angle and offset displacement of the anchoring holes. For example, according to one alternative embodiment, each anchoring attachment may be inserted through a bracket disposed within a top indentation of the base. The bracket may have rounded edges that abut a rounded surface of the top indentation so that the bracket is able to pivot about an axis parallel to the lateral direction. The bracket may also have a rounded shoulder with a slot through which the anchoring attachment extends to permit pivotal motion of the anchoring attachment with respect to the bracket, about an axis parallel to the longitudinal direction. A head of the anchoring attachment may be disposed above the shoulder, and may be rotatable by hand to threadably engage the anchoring attachment into the corresponding anchor.

Each of the anchoring attachments may pass through a hole in the base to reach the anchoring holes. The holes in the base may be somewhat oversized to permit the anchoring attachments to be disposed at angles that are not perpendicular to the playing surface. Hence, the anchoring holes need not be precisely vertical or exactly offset from each other to receive the anchoring attachments. The base may be anchored by simply disposing the base over the anchoring holes, positioning the anchoring attachments in alignment with the anchoring holes, and rotating the heads to anchor the anchoring attachments within the anchors in the anchoring holes.

According to another alternative embodiment, the base may have a top indentation with a flat portion. A bracket may be affixed to the flat portion in such a manner that the bracket does not move with respect to the base. The anchoring attachment may pass through the bracket and through an oversized hole in the base. Again, a manually rotatable head may be disposed above the bracket. However, the anchoring attachment may have a threaded portion that engages interior threads of the head so that rotation of the head does not necessarily rotate the anchoring attachment, but instead causes generally vertical motion of the anchoring attachment as the threaded portion is received into or expelled from the head.

Additionally, the anchoring attachment may not be a straight bolt, but may rather have a hooked shape with a curved portion at the lower end. The curved portion may engage an eyelet threaded into the anchor. Thus, the anchoring attachment may be moved into an anchored position by rotating the head to lower the anchoring attachment, inserting the curved portion into the eyelet, and then rotating the head in the opposite direction to raise the anchoring attachment until the anchoring attachment pulls firmly against the eyelet.

Support struts of the portable basketball goal assembly may be attached directly to the brackets, thereby providing a force transmittal assembly in which each component is constructed of a high strength material such as a metal. Hence, the portable basketball goal assembly may be resilient under comparatively more rigorous play.

These and other objects, features, and advantages of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained will be readily understood, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The presently preferred embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the embodiments of the apparatus, system, and method of the present invention, as represented in FIGS. 1 through 6, is not intended to limit the scope of the invention, as claimed, but is merely representative of presently preferred embodiments of the invention.

For this application, the phrases "connected to," "coupled to," and "in communication with" refer to any form of interaction between two or more entities, including mechanical, electrical, magnetic, electromagnetic, and thermal interaction. The phrase "attached to" refers to a form of mechanical coupling that restricts relative translation or rotation between the attached objects. The phrases "pivotally attached to" and "slidably attached to" refer to forms of mechanical coupling that permit relative rotation or relative translation, respectively, while restricting other relative motion.

The phrase "rigidly attached to" refers to mechanical coupling that comparatively tightly restricts relative translation or rotation between the attached objects, to the extent that relative motion beyond that associated with operational vibration is substantially unable to occur. The phrase "attached directly to" refers to a form of attachment by which the attached items are either in direct contact, or are only separated by a single fastener, adhesive, or other attachment mechanism. The term "abutting" refers to items that are in direct physical contact with each other, although the items may not be attached together.

Figure 1:
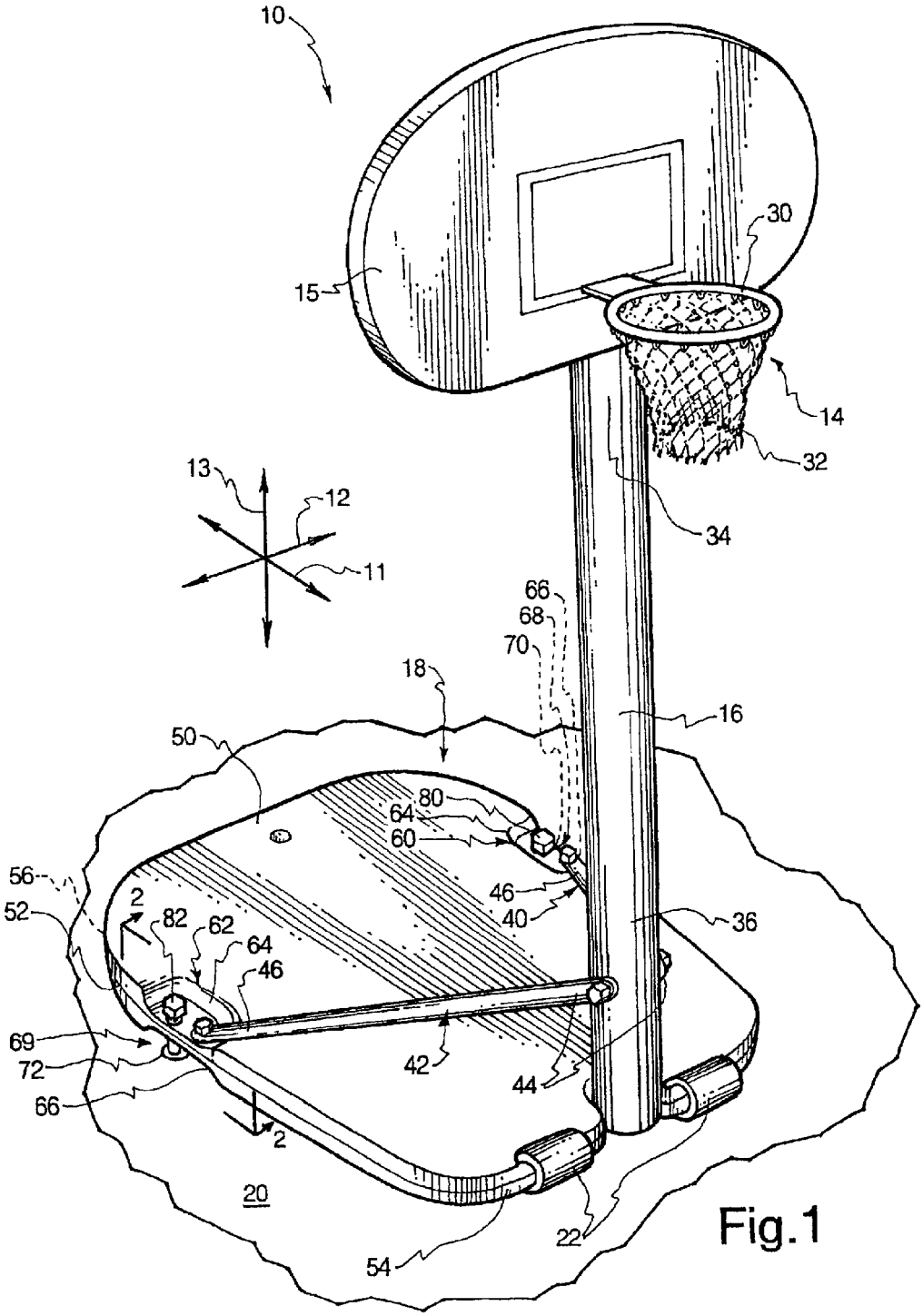
FIG. 1 is a perspective view of a portable basketball goal assembly attached to a playing surface through the use of two anchoring assemblies according to the invention.

Referring to FIG. 1, one embodiment of a portable basketball goal assembly 10 according to the invention is depicted. The portable basketball goal assembly 10 has a longitudinal direction 11, a lateral direction 12, and a transverse direction 13. A goal 14 is disposed on a backboard 15, which is oriented generally vertically. A support pole 16 supports the backboard 15 and is affixed to a base 18 that provides ballast and support for the support pole 16. The base 18 may extend generally rearward of the support pole 16 to most effectively balance the support pole 16 against tipping forward during use. The base 18 may rest on a playing surface 20, which is preferably a comparatively hard, flat surface such as concrete or asphalt. The base 18 may also be suspended above the playing surface by various fixtures (not shown) extending from the base 18, if desired.

The base 18 may have one or more motion facilitating members designed to facilitate motion of the base 18 along the playing surface 20 so that the user may more easily set up, adjust, and store the portable basketball goal assembly 10. Such motion facilitating members may, for example, take the form of wheels 22. Alternatively, the motion facilitating members may be casters, tracks, or other implements designed to selectively facilitate movement of the base 18.

The goal 14 may have a rim 30 and a net 32, each of which is preferably of a standard size. The rim 30 is disposed generally perpendicular to the backboard 15. The support pole 16 need not be straight and round, as depicted, but may have any shape suitable for supporting the backboard 15. Preferably, the support pole 16 is constructed of a stiff, strong material such as metal or a metal alloy. Steel is a presently preferred material. The support pole 16 may have a first end 34 disposed near the backboard 15 and a second end 36 disposed near the base 18. The first end 34 may be affixed to the backboard 15 by any suitable fixed or adjustable attachment (not shown).

Preferably, a first support strut 40 and a second support strut 42 are attached to the support pole 16 to transfer rotational loads, or moments, from the support pole 16 to the base 18. More specifically, first ends 44 of the support struts 40, 42 may be affixed to opposite sides of the support pole 16, and second ends 46 of the support struts 40, 42 may be affixed to opposite sides of the base 18. Thus, the attachment of the second end 36 of the support pole 16 to the base 18 need not support all of the force between the support pole 16 and the base 18.

The base 18 may be constructed of a lightweight material, such as plastic, and may be made hollow so that an inexpensive, readily-available ballast material such as sand or water can be inserted into the base 18 after the assembly 10 has been properly positioned. The base 18 may be fabricated through injection molding, blow molding, or the like. Blow molding may advantageously provide the hollow configuration without requiring the injection of plastic at high pressures. The base 18 may also be constructed as two separate halves attached together through the use of fasteners, adhesives, or the like. In any case, the base 18 may have a top shell 50 and a bottom shell 52 formed either individually or unitarily.

The base may generally have a front edge 54 and a rear edge 56. In the case of downward force applied to the rim 30, as when a player grasps the rim during a dunking maneuver, the rear edge 56 of the base 18 will tend to rise as the portable basketball goal assembly 10 rotates around the front edge 54. When force is applied backward against the backboard 15, as when a basketball strikes the backboard 15 during play, the front edge 54 will tend to rise as the portable basketball goal assembly 10 rotates about the rear edge 56.

The second ends 46 of the support struts 40, 42 may be attached to the base 18 at a first mounting region 60 and a second mounting region 62 of the base 18, respectively. Preferably, the mounting regions 60, 62 comprise thinner sections of the base 18 through which a fastener can be threaded. More specifically, each of the mounting regions 60, 62 may comprise a top indentation 64 formed in the top shell 50 and a bottom indentation 66 formed in the bottom shell 52. The indentations 64, 66 are positioned back-to-back, in abutting fashion, to form the mounting regions 60, 62.

The mounting regions 60, 62 may also be used to anchor the base 18 to the playing surface 20. More specifically, first and second anchoring assemblies 68, 69 maybe provided to affix the first and second mounting regions 60, 62, respectively, to the playing surface 20. The first and second anchoring assemblies 68, 69 may have a first anchor 70 and a second anchor 72, respectively, disposed within the playing surface 20 to receive a first anchoring attachment 80 and a second anchoring attachment 82 connected to the base 18.

When the anchoring attachments 80, 82 are coupled to the anchors 70, 72, the anchoring attachments 80, 82 are in an anchored configuration. In the anchored configuration, the base 18 is rigidly attached to the playing surface 20 so that no substantial motion of the base 18 with respect to the playing surface 20 is able to occur. Forces against the goal 14 are then transmitted through the support pole 16, to the base 18, and to the playing surface 20 via the anchoring assemblies 68, 69.

Figure 2:
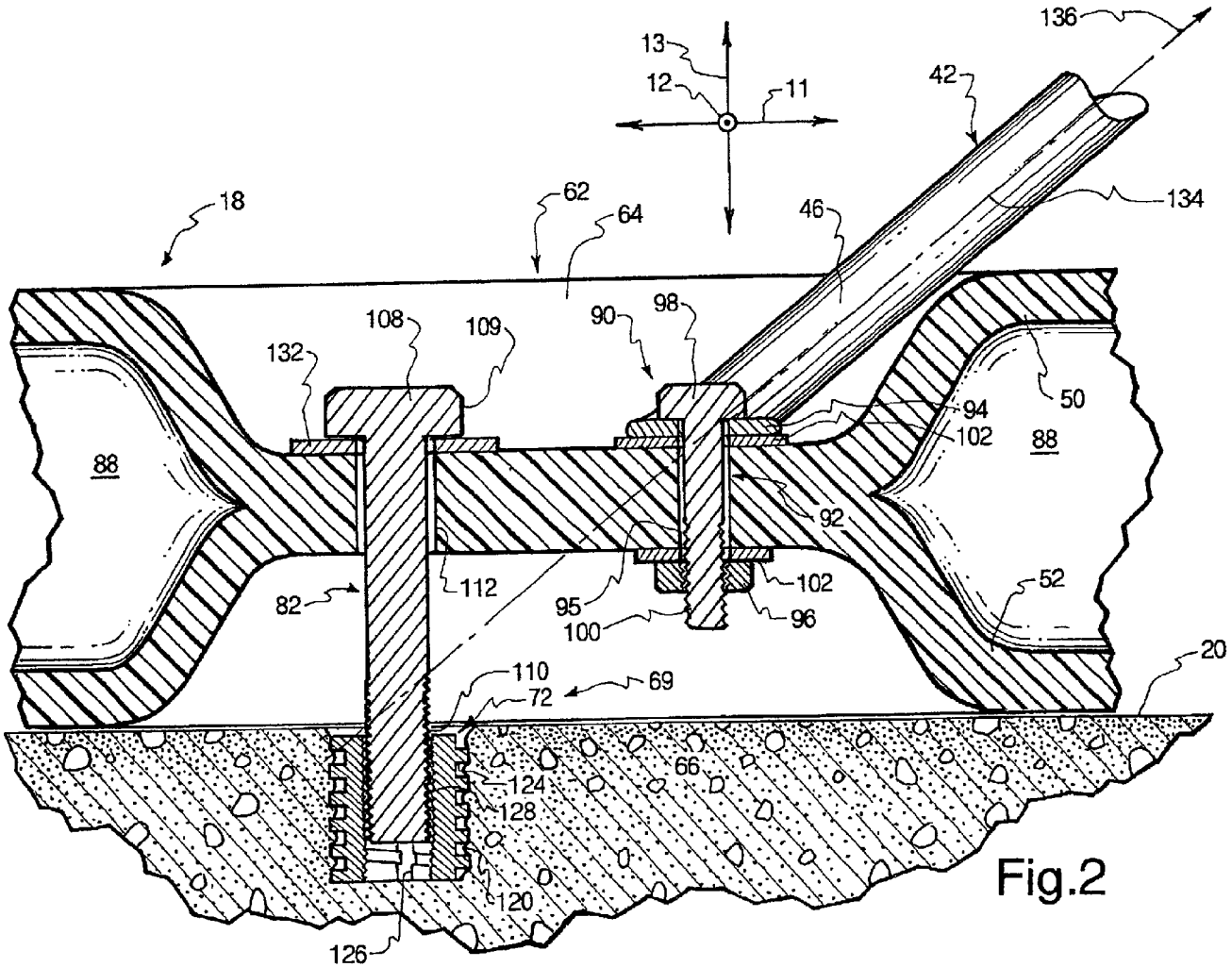
FIG. 2 is a side elevation, sectioned view of one of the anchoring assemblies of FIG. 1, in an anchored configuration.

Conversely, when the anchoring attachments 80, 82 are not coupled to the anchors 70, 72, the anchoring attachments 80, 82 are in a free configuration. The base 18 can then move relative to the playing surface 20. Hence, a person may position the portable basketball goal assembly 10 in a location desirable for play and move the anchoring attachments 80, 82 into the anchored configuration. When it is desirable to store or otherwise move the portable basketball goal assembly 10, the anchoring attachments 80, 82 are disposed in the free configuration to permit motion of the base 18. The anchoring attachments 80, 82 may be movable between the anchored and the free configuration by hand, i.e., without tools. FIG. 2 will show the structure and operation of the anchoring assemblies 68, 69 in greater detail.

Referring to FIG. 2, a sectioned view of the second anchoring assembly 69 in the anchored configuration, i.e., in use to attach the base 18 to the playing surface 20, is shown. The various components of the first anchoring assembly 68 may be assumed to have configurations substantially to those of the second anchoring assembly 69; hence, the following discussion also applies to the first anchoring assembly 68.

The hollow base 18 may have a cavity 88 filled with a ballast material, as described above. The ballast material adds weight to the base 18 to enhance the stability of the portable basketball goal assembly 10 during game play. The second support strut 42 may be attached to the second mounting region 62 proximate the second anchoring assembly 69 by an attachment assembly 90. The attachment assembly 90 may include a fastener 92, such as a bolt 92 threaded through an attachment flange 94 of the support strut 42. The bolt 92 may also extend through a hole 95 in the second mounting region 62 and through a nut 96.

A head 98 of the bolt 92 is shaped to be twisted by hand or through the use of a tool, such as a wrench. A threaded portion 100 of the bolt 92 may be engaged within the nut 96, the interior diameter of which may have matching threads. The bolt 92 may also be threaded through washers 102 positioned next to the surface of the second mounting region 62 to protect the material of the mounting region 62 from scraping, shear stresses, and compressive stresses caused by the installation of the attachment assembly 90.

The second anchoring attachment 82 may take the form of a straight bolt configured to be engaged and disengaged by hand. More specifically, the second anchoring attachment 82 of the second anchoring assembly 69 may also have a head 108. However, the head 108 of the second anchoring attachment 82 is preferably configured to be gripped and easily rotated by a user without the aid of tools. Thus, vertical ridges 109 or some other feature may be formed on the outer periphery of the head 108 to enable a user to grip the head 108 without slipping. The second anchoring attachment 82 may also have a threaded portion 110 opposite the head 108.

The base 18 may have an anchoring feature that engages the second anchoring attachment 82. Such an anchoring feature may take the form of a recessed lip, a pair of adjacent horizontal tabs, a hole, or any other feature that permits the second anchoring attachment 82 to overlap the base 18 to restrain vertical motion of the base 18. In the base 18 of FIG. 2, the anchoring feature takes the form of a hole 112 in the second mounting region 62. The second anchoring attachment 82 extends through the hole 112 to reach the playing surface 20. A similar hole (not shown) may be present in the first mounting region 60.

The second anchor 72 may be positioned within an anchoring hole 120 in the playing surface 20. A similar anchoring hole (not shown) may be used in conjunction with the first anchor 70. Preferably, the second anchor 72 takes the form of a commercially available concrete or masonry anchor. Thus, the second anchor 72 may have a generally tubular shape, with ridges 124 or other features designed to frictionally engage the wall of the anchoring hole 120. The second anchor 72 may also have a slit 126 extending along the full length of the second anchor 72 to enable the second anchor 72 to expand when the threaded portion 110 of the second anchoring attachment is introduced. The second anchor 72 may also have a threaded portion 128 disposed on the inside diameter of the second anchor 72 so that the threaded portion 110 of the second anchoring attachment 82 can be twisted into engagement with the threaded portion 128 of the second anchor 72.

The anchoring hole 120 may be formed using a drill with a masonry bit, or some other similar tool for creating holes in concrete or masonry. The anchoring hole 120 may be on the order of one-half inch in diameter. Preferably, the second anchor 72, in its undeflected state, is sized slightly narrower than the anchoring hole 120 so that the second anchor 72 can be easily slid into position prior to insertion of the threaded portion 110. Like the bolt 92, the second anchoring attachment 82 may be threaded through a washer 132 positioned between the head 108 and the material of the second mounting ridge. In certain embodiments, the washer 132 and the washer 102 may be formed of a single piece of material, with separate holes to accommodate the bolt 92 and the second anchoring attachment 82.

Through the use of the anchoring assemblies 68, 69, the portable basketball goal assembly 10 maybe easily anchored to the playing surface 20 for play and detached from the playing surface 20 for repositioning or storage. The anchoring process may commence with formation of the anchoring holes 120, as described above. The anchors 70, 72 may then be inserted into the anchoring holes 120.

Next, the base 18 maybe positioned such that the anchoring features of the base 18, or the holes 112, are substantially aligned with the anchoring holes 120. Substantially aligning the anchoring features with the anchoring holes 120 comprises positioning the anchoring features over the anchoring holes 120 such that each anchoring feature is disposed on or near the axis of symmetry of one of the anchoring holes 120. Positioning of the base maybe carried out prior to assembly of the support pole 16 and the goal 14 with the base 18, or after the remainder of the portable basketball goal assembly 10 has been assembled.

The anchoring attachments 80, 82 may then be inserted into the holes 112 if they are not already disposed within the holes 12. The anchoring attachments 80, 82 may be moved from the free configuration to the anchored configuration by pushing the anchoring attachments 80, 82 downward to abut the anchors 70, 72 and then rotating the anchoring attachments 80, 82 to engage the threaded portions 110 with the anchors 70, 72. As mentioned previously, the heads 108 of the anchoring attachments 80, 82 maybe shaped to permit rotation of the anchoring attachments 80, 82 by hand. The anchoring attachments 80, 82 may be rotated until they rest tightly against the top indentations 64 of the mounting regions 60, 62.

The portable basketball goal assembly 10 has then been anchored to the playing surface 20 for play. The portable basketball goal assembly 10 may be unanchored by reversing the steps described above. Hence, the anchoring attachments 80, 82 may be rotated, for example, by hand, to disengage the threaded portions 110 from the anchors 70, 72. The anchoring attachments 80, 82 may then be drawn upward, away from the playing surface 20. If desired, the anchoring attachments 80, 82 may be removed entirely from the holes 112 of the base 18. In any case, the anchoring attachments 80, 82 have been moved into the free configuration so that the base 18 may be removed with respect to the playing surface 20.

When the anchoring attachments 80, 82 are in the anchored configuration, the anchoring assemblies 68, 69 may transfer tensile or compressive force from the pole 16 to the playing surface 20. For example, when a person hangs on the rim of the goal 14, as in a dunking maneuver, the resulting moment tends to rotate the portable basketball goal assembly 10 about the front edge 54 of the base 18. The support struts 40, 42 are placed in tension, and thus exert force on the base 18 that tends to pull the rear edge 56 upward.

The mounting assemblies 68, 69 receive the tension from the support struts 40, 42, and transmit the tension to the playing surface 20. More specifically, in the embodiment of FIG. 2, tension is transmitted through the support struts 40, 42 to the base 18 via the attachment assemblies 90 that attach the struts 40, 42 to the base 18. The tension is further transmitted to the anchoring attachments 80, 82 through the base 18 as the base pulls upward against the heads 108 of the anchoring attachments 80, 82. The anchoring attachments 80, 82 transmit the tension to the anchors 70, 72, which are firmly fixed within the playing surface 20. Hence, the tension against the rim of the goal 14 is dissipated without permitting substantial relative motion between the base 18 and the playing surface 20.

The positioning of the anchoring assemblies 68, 69 within the mounting regions 60, 62 enables the anchoring assemblies 68, 69 to more directly receive force through the support struts 40, 42. More specifically, with reference to the second anchoring assembly 69 shown in FIG. 2, the second support strut 42 may have a lengthwise axis 134 running through the first and second ends 44, 46 of the second support strut 42. The lengthwise axis 134 runs through or close to the point at which the second support strut 42 attaches to the base 18 and to the support pole 16. If the second support strut 42 is a substantially straight member with a generally circular cross section, as depicted in FIGS. 1 and 2, the lengthwise axis 134 is also the axis of symmetry of the second support strut 42.

Because the second anchoring assembly 69 is positioned so close to the attachment assembly 90 for the second support strut 42, the lengthwise axis 134 runs near the second anchoring assembly 69. Thus, the moment arm of a tensile or compressive force 136 through the second support strut 42 is minimal. As a result, only a very small bending moment occurs in the second anchoring assembly 69.

Consequently, bending stresses in the second anchoring attachment 82 are reduced, and the second anchoring attachment 82 is less likely to bend under the repeated stress of basketball goal use. Similarly, the stress exerted by the second anchoring attachment 82 against the hole 112, tending to compress or otherwise deform the softer material surrounding the hole 112, is reduced. Accordingly, positioning the second anchoring assembly 69 close to the lengthwise axis 134 provides advantages over any position in which the second anchoring assembly 69 is further from the lengthwise axis 134, such as the front or rear edges 54, 56 of the base 18.

According to one example, the lengthwise axis 134 may pass within twelve inches of the axis of the second anchoring assembly 69, or the axis of symmetry of the second anchoring attachment 82. Further, the lengthwise axis 134 may pass within six inches of the axis of the second anchoring assembly 69. Yet further, the lengthwise axis 134 may pass within two inches of the axis of the second anchoring assembly 69.

Figure 3:
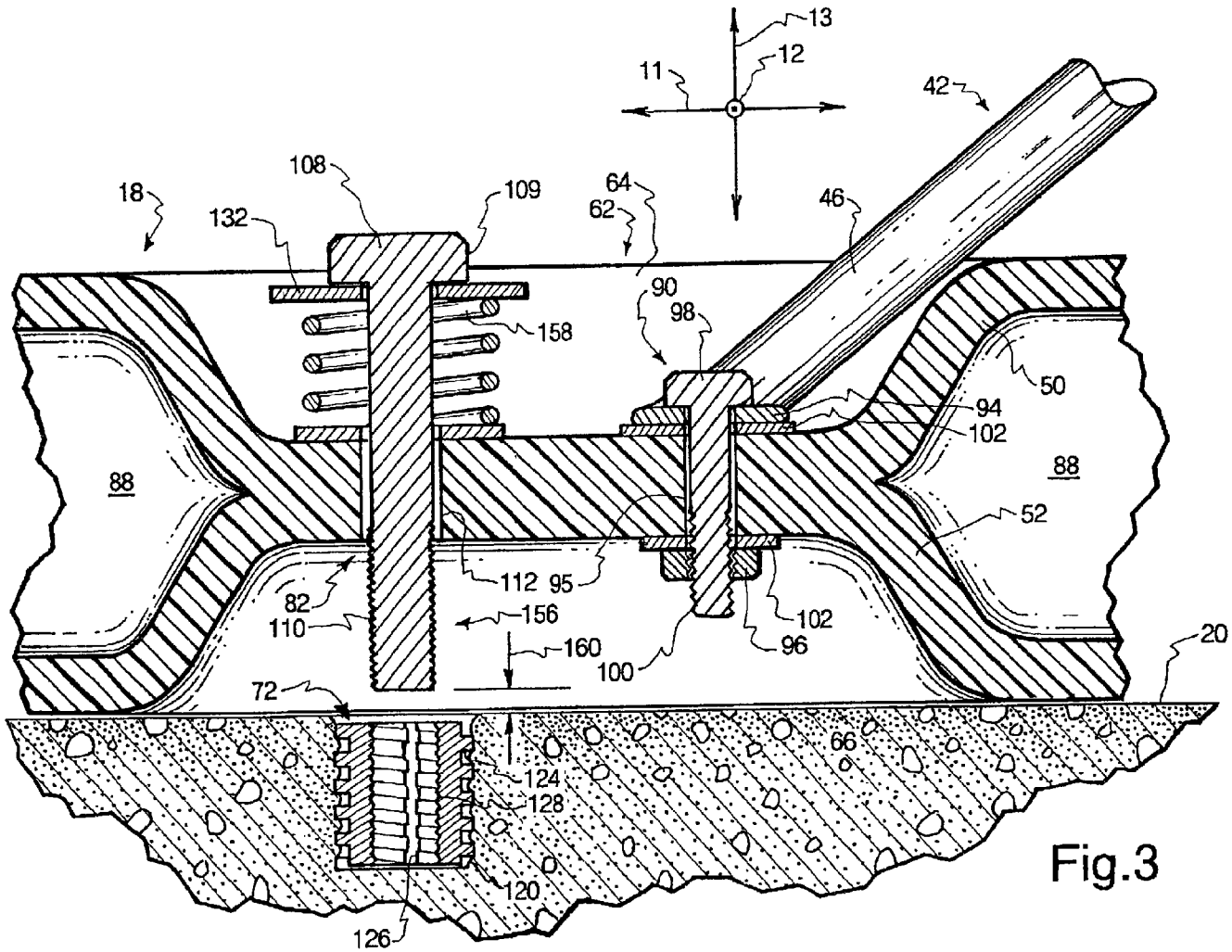
FIG. 3 is a side elevation, sectioned view of an alternative embodiment of an anchoring assembly, in a free configuration, with a resilient member to urge the anchoring attachment away from the anchor.

Referring to FIG. 3, a sectioned view of the base 18 is depicted with an alternative embodiment of an anchoring assembly 156 according to the invention. The second anchoring attachment 82 and the second anchor 72 may be configured substantially as described previously, in connection with the first embodiment. The second anchoring attachment 82 is disposed in the free configuration.

In addition to previously described components, the anchoring assembly 156 may include a resilient member 158 configured to urge the second anchoring attachment 82 upward, away from the second anchor 72. Although the resilient member 158 may take a variety of forms, such as one or more torsional springs, leaf springs linear springs, angular springs, gas springs, or any combination thereof, a simple linear spring 158, as depicted in FIG. 3, is preferable. The spring 158 may be positioned between the washer 132 and the material of the second mounting region 62, around the hole 112.

When the second anchoring attachment 82 is in the anchored configuration, the spring 158 is held in a compressed state. When a user twists the head 108 to disengage the second anchoring attachment 82 from the second anchor 72, the spring 158 presses the second anchoring attachment 82 upward so that a clearance 160 exists between the second anchoring attachment 82 and the playing surface 20. Thus, the base 18 can be moved in the longitudinal direction 11 or the lateral direction 12 without dragging the second anchoring attachment 82 against the playing surface 20. This makes the portable basketball goal assembly 10 easier to move and decreases the probability that the anchoring assemblies 68, 69 or the playing surface 20 will be damaged during movement.

Figure 4:
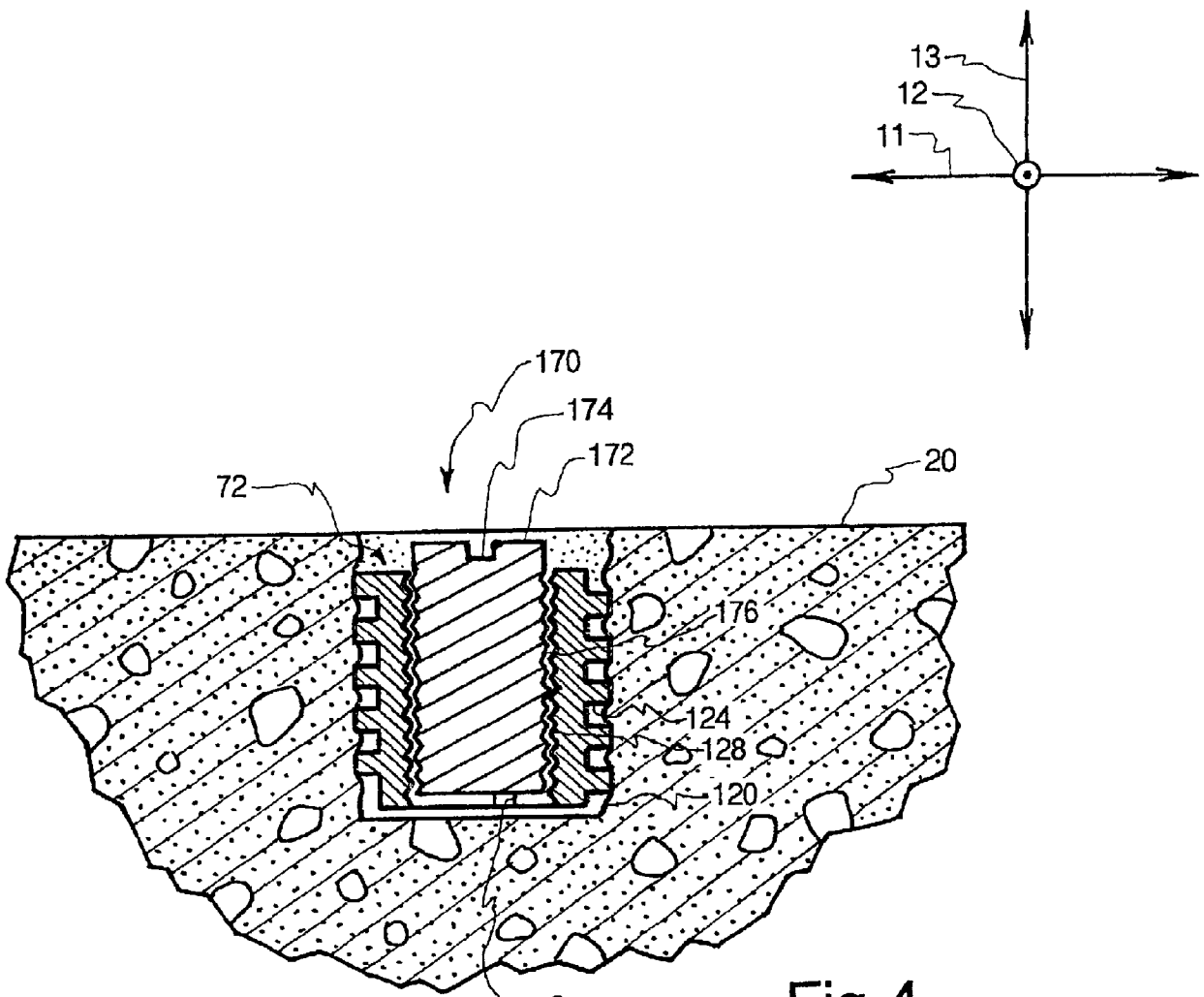
FIG. 4 is a side elevation, sectioned view of an anchor disposed within an anchoring hole, containing a plug according to the invention.

Referring to FIG. 4, one possible embodiment is shown of a plug 170 suitable for covering the anchoring hole 120 when the portable basketball goal assembly 10 is positioned elsewhere or stored away. The plug 170 may be constructed, for example, of a softer material such as a polymer. The plug 170 may have a face 172 with a slot 174, keyhole, or other feature designed to enable a user to engage the face 172 with a tool to rotate the plug 170 into or out of engagement with the second anchor 72. The plug 170 may also have a threaded portion configured to provide threaded engagement with the threaded portion 128 of the second anchor 72.

The plug 170 helps to effectively seal the anchoring hole 120 from moisture or debris that might otherwise enter the hole 120. Moisture is especially problematic during the winter, when freezing water could crack the playing surface 20 surrounding the anchoring hole 120 as it expands. The face 172 is preferably flush with, or slightly recessed from, the playing surface 20 so that the playing surface 20 can still be used without significant danger of injury as a result of the plug 170.

The anchoring assemblies 68,69 described above are simple in design and relatively easy to manufacture. However, some users may have difficulty drilling the anchoring holes 120 in the proper locations and orientations. For example, if the drill bit strikes a piece of aggregate material, the anchoring holes 120 may be displaced or angled. The anchoring holes 120 may not be exactly perpendicular to the playing surface 20, and may not be offset from each other by the precisely correct lateral displacement. Hence, it may be advantageous to utilize anchoring assemblies that permit some relative motion between the anchoring attachments and the base, to accommodate anchoring holes 120 that are not directly aligned with the holes 112 of the base 18. Exemplary anchoring assemblies that permit such relative motion will be shown and described with reference to FIGS. 5 and 6.

Figure 5:
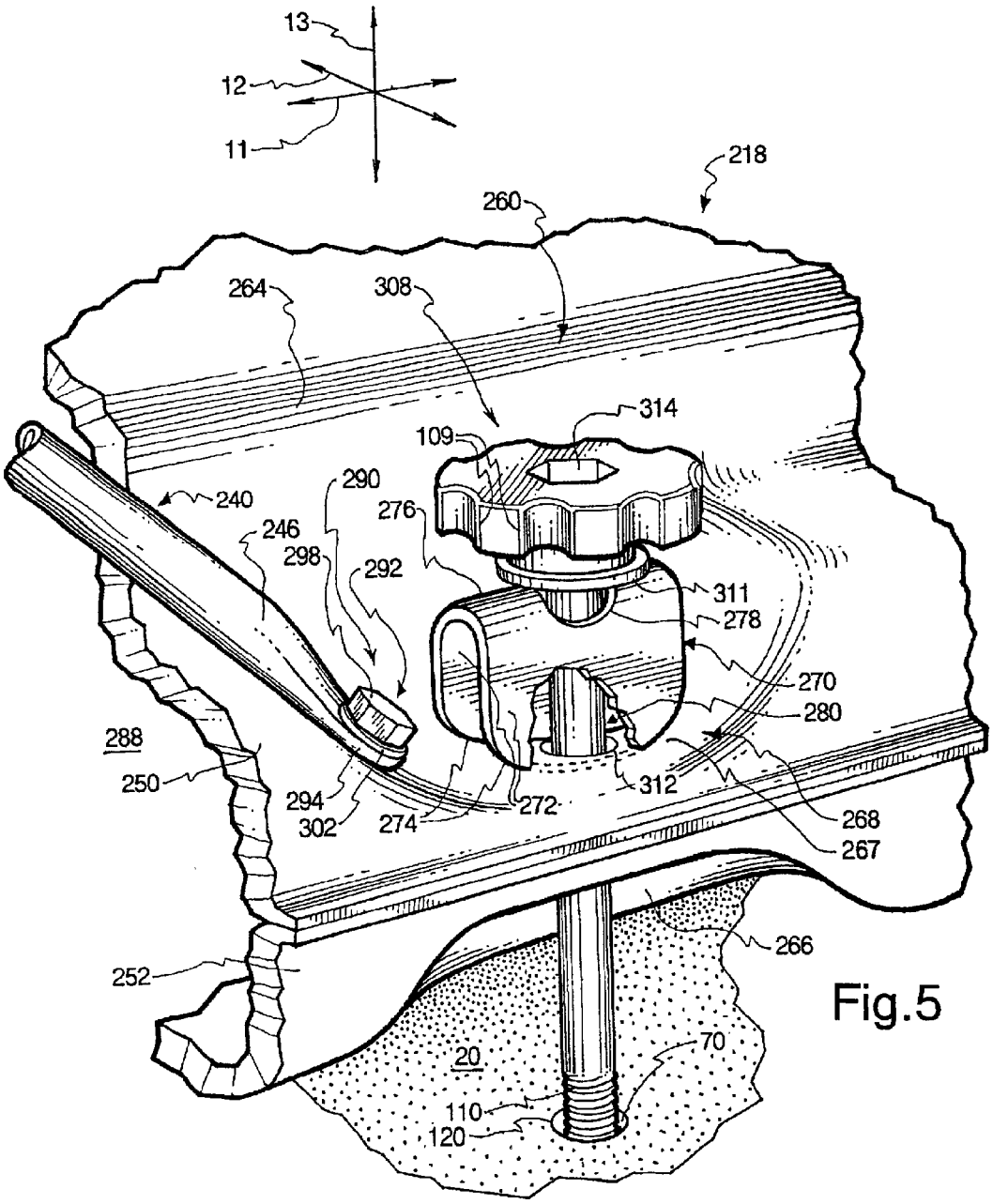
FIG. 5 is a perspective view of a portion of another alternative embodiment of an anchoring assembly within the scope of the present invention.

Referring to FIG. 5, a perspective view shows a portion of an alternative embodiment of a base 218 for a portable basketball goal assembly. The base 218 may be used with a goal 14, backboard 15, and support pole 16 similar to those depicted in FIG. 1. A portion of a first support strut 240 is also shown; a second end 246 of the first support strut 240 is affixed to the base 218. Like the base 18, the base 218 has a top shell 250 and a bottom shell 252 that may be integrally formed with each other or attached through the use of known attachment methods. The base 218 may also be constructed of a lightweight material such as a polymer.

A first mounting region 260 is formed within the base 218. The first mounting region may include a top indentation 264 and a bottom indentation 266 that are aligned so that a comparatively thin portion of the base 218 exists between the top and bottom indentations 264, 266. The top indentation 264 may be shaped to form a saddle-shaped portion 267 with a generally arcuate shape. A first anchoring assembly 268 interfaces with the first mounting region 260 to anchor the base 218 to the playing surface 20 through the use of an anchoring hole 120. A first anchor 70 may be disposed within the anchoring hole 120. Of course, a second anchoring assembly (not shown) with a corresponding anchor (not shown) and anchoring hole (not shown) may be disposed on the opposite side of the base 318.

The first anchoring assembly 268 may include a bracket 270 with two generally parallel faces 272. The bracket 270 may be constructed of a high strength material such as steel. For this application, a "high strength material" comprises any material with a comparatively high tensile strength, such as steel, aluminum, and certain composites. Polymers are not high strength materials.

Each of the faces 272 may have a rounded edge 274 with a radius approximately equal to that of the saddle-shaped portion 267 of the top indentation 264. The faces 272 may be joined by a rounded shoulder 276. The rounded shoulder 276 may be rounded along an axis perpendicular to that of the rounded edges 274 of the faces 272. A slot 278 may be disposed on the rounded shoulder 276.

A first anchoring attachment 280 extends through the slot 278 and between the plates 272. A threaded portion 110 of the first anchoring attachment 280 may engage the first anchor 70 when the first anchoring attachment 280 is disposed in the anchored configuration, as shown in FIG. 5.

The shells 250, 252 of the base 218 may fit together in such a manner that a cavity 288 is formed between them. As with the base 18, the cavity 288 may be filled with sand, water, or some other suitable ballast material. The first anchoring attachment 280 may extend through a portion of the cavity 288. Alternatively, the first anchoring attachment 280 may simply extend through the material of the base 18, outside the cavity 288.

The first support strut 240 may be attached to a sloped portion of the top indentation 264 via an attachment assembly 290 that includes a bolt 292 inserted through a flattened attachment flange 294 of the first support strut 240. The bolt 292 may have a head 298 disposed above the flattened attachment flange 294; if desired, the head 298 and the flattened attachment flange 294 may be separated from each other by a washer 302. The bolt 292 may be threaded directly into the material of the base 18. Alternatively, a nut or other fastener may be threaded onto the bolt 292 to hold the bolt 292 in place. The bolt 292 may extend into the cavity 288, or may extend through the cavity 288 to exit the case 18 through the bottom shell 252. Hence, the nut may then be disposed within the cavity 288 or on the portion of the bolt 292 that extends from the bottom shell 252.

The first anchoring attachment 280 may have a head 308 like the heads 108 of the anchoring attachment 80, 82 of the previous embodiment. Hence, the head 308 may have ridges 109 that facilitate rotation of the head 308 by hand. The first anchoring attachment 280 may have an abutment 311 disposed underneath the head 308 to rest against the rounded shoulder 276 of the bracket 270. The base 218 may have a hole 312 through which the first anchoring attachment 280 extends to reach the first anchor 70. The head 308 maybe formed separately from the remainder of the first anchoring attachment 280. The head 308 may have an aperture 314 with a polygonal shape that mates with a corresponding polygonal extension (not shown) of the stem of the first anchoring attachment 280 so that torque can be transmitted from the head 308 to the remainder of the first anchoring attachment 280.

The hole 312 maybe somewhat oversized so that the first anchoring attachment 280 is able to move in the longitudinal and lateral directions 11, 12 within the hole 312. If desired, the hole 312 may be about ⅔ the diameter of the first anchoring attachment 280. For example, the stem of the first anchoring attachment 280 maybe about ⅜" in diameter, while the hole 312 is about ½" in diameter. If desired, the plastic surrounding the hole 312 may be thick enough to surround the hole 312 along its entire depth, thereby isolating the hole 312 from the cavity 288. The hole 312 may have a depth equal to about half its width; for example, if the hole 312 is ½" wide, the hole 312 may also be about ¼" deep. Of course, the dimensions provided above are merely examples; many different dimensional schemes may be used for the hole 312 and the first anchoring attachment 280.

The geometry of the bracket 270 and the size of the hole 312 may operate to permit disposition of the first anchoring attachment 280 at an angle that is not precisely perpendicular to the playing surface 20. More specifically, the manner in which the rounded edges 274 of the faces 272 of the bracket 270 interface with the saddle-shaped portion 267 of the top indentation 264 enables the bracket 270, and hence the first anchoring attachment 280, to pivot about an axis parallel to the lateral direction 12. Similarly, the slot 278 and the rounded shoulder 276 permit the first anchoring attachment 280 to pivot about an axis parallel to the longitudinal direction 11. Thus, the first anchoring attachment 280 may be angled somewhat closer to one of the faces 272 than to the other.

The bracket 270 enables the first anchoring attachment 280 to be securely tightened at orientations that are not completely perpendicular to the playing surface 20. Hence, some variation in the position and orientation of the anchoring hole 120 will not significantly interfere with anchoring of the base 218. The user may simply angle the first anchoring attachment 280 as needed prior to disposition of the fist anchoring attachment 280 in the anchored configuration. The user may therefore anchor the base 218 in a manner similar to that of the base 18, except that brackets must be positioned over the anchoring features of the base 318, and the anchoring attachments of the base 218 must be inserted into brackets prior to insertion through the anchoring features of the base 218.

The embodiment of FIG. 5 provides for the transmittal of force from the goal 14 playing surface 20 in substantially the same manner as described above, with reference to FIG. 2. The first anchoring assembly 268 receives tension or compression from the first support strut 240 and transmits the same to the anchor 70. For example, tension is transmitted from the attachment assembly 290 of the first support strut 240 to the bracket 270 through the small region of the saddle-shaped portion 267 that is disposed between the attachment assembly 290 and the bracket 270. The bracket 270 transmits tension to the first anchoring attachment 280, and the first anchoring attachment 280 transmits the tension to the first anchor 70.

As with the previous embodiment, the disposition of the second end 246 of the first support strut 240 near the first anchoring attachment 280 may minimize stresses caused by moments induced by the axial force in the first support strut 240. Of course, a second strut and second anchoring assembly maybe included with the base 218 and may provide a similar pathway for tension transmittal from the goal 14 to the playing surface 20. The tensile load from the goal 14 maybe divided substantially evenly between the two pathways. Additional support struts and additional anchoring assemblies may be included to add more pathways for tension transmittal. Thus, the base 218 need not be anchored at only two points, but may be anchored at three or more points to provide additional support.

All portions of the above-defined force transmittal assembly are constructed of high-strength materials except for the portion of the saddle-shaped portion 267 between the attachment assembly 290 and the bracket 270. The saddle-shaped portion 267 may be constructed of a lightweight, comparatively low strength material. Hence, in goal systems in which more vigorous play is likely to occur, it may be desirable to provide a bracket arrangement that can directly receive a support strut, so that lightweight materials can be omitted entirely from the pathway followed by the tensile forces. Such a goal system is shown in FIG. 6.

Figure 6:
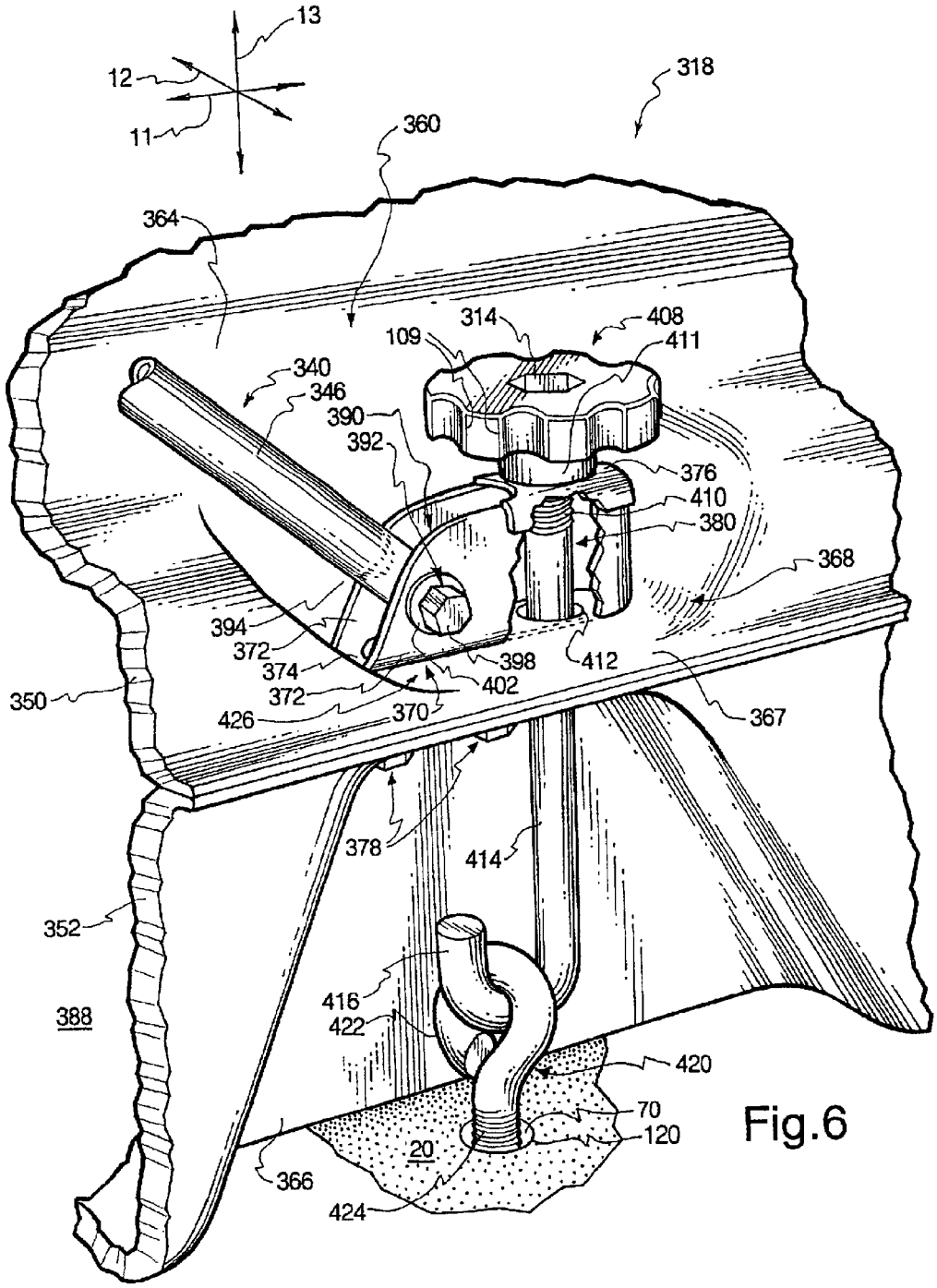
FIG. 6 is a perspective view of a portion of yet another alternative embodiment of an anchoring assembly within the scope of the present invention.

Referring to FIG. 6, a perspective view shows a portion of another alternative embodiment of a base 318 for a portable basketball goal assembly. Like the base 218, the base 318 may be used with a goal 14, backboard 15, and support pole 16 similar to those depicted in FIG. 1. A second end 246 of a first support strut 340 may be affixed to the base 318. Like the base 18 and the base 218, the base 318 has a top shell 350 and a bottom shell 352 that may be integrally formed with each other or attached through the use of known attachment methods. The base 318 may also be constructed of a lightweight material such as a polymer.

As with the previous embodiment, a first mounting region 360 is formed within the base 318. The first mounting region may include a top indentation 364 and a bottom indentation 366 that are aligned so that a comparatively thin portion of the base 318 exists between the top and bottom indentations 364, 366. The top indentation 364 may be shaped to form a flat portion 367 generally parallel to the playing surface 20. A first anchoring assembly 368 interfaces with the first mounting region 360 to anchor the base 318 to the playing surface 20 through the use of an anchoring hole 120. A first anchor 70 may be disposed within the anchoring hole 120. Of course, a second anchoring assembly (not shown) with a corresponding anchor (not shown) and anchoring hole (not shown) may be disposed on the opposite side of the base 318.

The first anchoring assembly 368 may include a bracket 370 with two generally parallel faces 372 joined to each other via a bottom flange 374. Like the bracket 270 of the previous embodiment, the bracket 370 may be constructed of a high strength material such as steel. The parallel faces 372 may also be joined together via a top plate 376. The bottom flange 374 may be affixed to the flat portion 376 of the top indentation 364 via two or more fastening assemblies 378. Each of the fastening assemblies 378 may be a nut-and-bolt combination, rivet, clip, or the like. A first anchoring attachment 380 may extend through the top plate 376, between the faces 372, and through the flat portion 367 to reach the bottom indentation 366.

The shells 350, 352 of the base 318 may fit together in such a manner that a cavity 388 is formed between them. As with the bases 18 and 218, the cavity 388 may be filled with sand, water, or some other suitable ballast material. The first anchoring attachment 380 may extend through the material of the base 18, outside the cavity 388.

The first support strut 340 may be attached to the faces 372 of the bracket 370 via an attachment assembly 390 that includes a bolt 392 inserted through a flattened attachment flange 394 of the first support strut 340. The flattened attachment flange 394 may be disposed generally perpendicular to the lateral direction 12. Hence, the bolt 392 may be disposed parallel to the lateral direction 12, and may extend through the faces 372 as well as the flattened attachment flange 394. The bolt 392 may have a head 398 and a washer 402 disposed on one side of the bracket 370, as well as a nut (not shown) disposed on the opposite side.

The first anchoring attachment 380 may have a head 408 similar to the heads 108, 308 of the previous embodiments in that the head 408 has ridges 109 that facilitate rotation of the head 408 by hand. However, unlike the heads 108, 308, the head 408 may not be rigidly attached to the remainder of the first anchoring attachment 380. Rather, the head 408 may have interior threads (not shown) designed to receive a threaded portion 410 on the shank of the first anchoring attachment 380. The head 408 may have an aperture 314 with any shape, such as the polygonal shape visible in FIG. 6. The aperture 314 may communicate with the interior threaded portion (not shown) of the head 408 to permit motion of the threaded portion 410 into and out of the head 408 without the resistance of high or low air pressure within the head 408.

The first anchoring attachment 480 may have an abutment 411 disposed underneath the head 408 to rest against the top plate 376 of the bracket 370. The base 318 may have a hole 412 through which the first anchoring attachment 380 extends to reach the bottom indentation 366. Like the hole 312, the hole 412 maybe somewhat oversized so that the first anchoring attachment 380 is able to move in the longitudinal and lateral directions 11, 12 within the hole 412. The hole 412 and the first anchoring attachment 480 may be dimensioned in a manner similar to the hole 312 and the first anchoring attachment 380 of FIG. 5. The hole 412 may also be isolated from the cavity 388 like that of the previous embodiment.

The first anchoring attachment 480 may have a shank 414 with a substantially cylindrical shape that extends through the hole 412. The first anchoring attachment 480 may terminate with a curved section 416 so that the first anchoring attachment 480 has a hooked shape. A retaining member may be disposed within the first anchor 70, and may be configured to engage the curved section 416 of the first anchoring attachment 480. As one example, the retaining member may take the form of an eyelet 420 with a ring portion 422 and a threaded portion 424. The threaded portion 424 may be rotated into engagement with the first anchor 70, while the ring portion 422 receives the curved section 416 of the first anchoring attachment 480, as depicted in FIG. 6.

The manner in which the base 318 is anchored to the playing surface 20 is somewhat different than that of the previous embodiments. More specifically, the base 318 may first be moved such that the hole 412 is disposed generally over the anchoring hole 120, but not necessarily in alignment with the anchoring hole 120. Of course, if the base has a second anchoring assembly (not shown), the corresponding hole and anchoring hole are similarly brought into close proximity.

The eyelet 420 may then be rotated into engagement with the first anchor 70. This may be accomplished by manually by grasping the ring portion 422 and twisting the eyelet 420 into place. The first anchoring attachment 380 may then be lowered to a position in which the curved section 416 of the first anchoring attachment 380 is able to interlock with the ring portion 422. The first anchoring attachment 380 may be lowered by grasping the curved section 416 to prevent rotation of the first anchoring attachment 380 and simultaneously rotating the head 408 to expel a segment of the threaded portion 410.

The base 318 may then be moved in the longitudinal direction 11 and/or the lateral direction 12 to generally, but not necessarily precisely, align the hole 412 with the anchoring hole 120 so that the curved section 416 is able to enter the ring portion 422 of the eyelet 420. The curved section 416 maybe inserted into the eyelet 420, and the head 408 maybe rotated to retract the threaded portion 410 until the curved section 416 pulls upward snugly against the eyelet 420. The first anchoring attachment 380 has then been moved into the anchored configuration. The first anchoring attachment 380 maybe returned to the free configuration by reversing the steps described above.

As with the previous embodiment, the first anchoring attachment 380 may be disposed at an angle that is not precisely perpendicular to the playing surface 20. More specifically, the engagement of the ring portion 422 with the curved section 416 permits some relative pivotal motion between the eyelet 420 and the first anchoring attachment 380 about axes parallel to the longitudinal and lateral directions 11, 12. Hence, the hole 412 need not be precisely aligned with the anchoring hole 120. The abutment 411 may abut the top plate 376 at plurality of angles to permit such pivotal motion.

In the anchored configuration, the first anchoring assembly 368 of FIG. 6 also transmits force from the goal 14 to the playing surface 20. More specifically, a force transmittal assembly 426 may include the first support strut 346, the bracket 370, and the first anchoring attachment 380. Axial force, and more especially tension, may be transmitted through the first support strut 340 directly to the bracket 370. The tension may then be conveyed to the first anchoring attachment 380 via the head 408, and from the first anchoring attachment 380 to the eyelet 420. From the eyelet 420, the tensile force is conveyed to the first anchor 70 and thence, to the playing surface 20.

Notably, the force transmittal assembly 426 of FIG. 6 need not include any part of the base 318. The force transmittal assembly 426 may be made entirely of high strength materials that resist deformation more effectively than lightweight materials such as plastics. Hence, the base 318 may tolerate comparatively more rigorous play.

As with previous embodiments, the disposition of the second end 346 of the first support strut 340 near the first anchoring attachment 380 may also minimize stresses caused by moments induced by the axial force in the first support strut 340. Of course, as with the previous embodiment, the force transmittal assembly 426 may include a second strut and a second anchoring assembly to provide a second pathway for tension transmittal from the goal 14 to the playing surface 20. The tensile load from the goal 14 may again be divided substantially evenly between the two pathways. Additional support struts and additional anchoring assemblies may also be included in the force transmittal assembly 426 to add more pathways for tension conveyance. Thus, the base 318 may also be anchored at three or more points to provide additional support.

Through the system and methods presented above, a portable basketball goal assembly may be effectively stabilized for safer and more enjoyable game play. The anchoring assemblies provided by the invention may be relatively easy to engage and disengage, thereby facilitating setup and removal of the portable basketball goal assembly. In certain configurations, the basketball goal assembly may be easy to anchor even if the anchoring holes are not precisely positioned or angled. Furthermore, in selected embodiments, a portable basketball goal assembly may have a force transmittal assembly constructed entirely of comparatively high strength materials, thereby providing reliable operation during more intense play.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

What is claimed and desired to be secured by United States Letters Patent is:

1. A portable basketball goal assembly that can be secured in a fixed position relative to a surface, the portable basketball goal assembly comprising:

a support pole;

a backboard and rim assembly connected to the support pole and at least partially positioned above a playing surface;

a base connected to the support pole, the base including one or more wheels to facilitate movement of the portable basketball goal assembly;

a first mounting region of the base;

a second mounting region of the base;

a first support strut connected to the support pole and to the first mounting region of the base;

a second support strut connected to the support pole and to the second mounting region of the base;

a first anchoring assembly including a fastener that extends through an opening in the first mounting region of the base and a retaining member that is connected to the surface, the fastener being connected to the retaining member to selectively hold the base in a fixed position relative to the surface; and a second anchoring assembly including a fastener that extends through an opening in the second mounting region of the base and a retaining member that is connected to the surface, the fastener being connected to the retaining member to selectively hold the base in a fixed position relative to the surface.

2. The portable basketball goal assembly as in claim 1, further comprising an upper section of the base and a lower section of the base, a first portion of the upper section of the base abutting a first portion of the lower section of the base to form at least a part of the first mounting region of the base, and a second portion of the upper section of the base abutting a second portion of the lower section of the base to form at least a part of the second mounting region of the base.

3. The portable basketball goal assembly as in claim 2, wherein a portion of the upper section of the base is spaced apart from a portion of the lower section of the base to form a generally hollow interior portion that is capable of being filled with ballast.

4. The portable basketball goal assembly as in claim 1, further comprising a head of the fastener of the first anchoring assembly that is disposed proximate an upper surface of the first mounting region of the base and an elongated body of the fastener of the first anchoring assembly that is at least partially received within the retaining member of the first anchoring assembly; and a head of the fastener of the second anchoring assembly that is disposed proximate an upper surface of the second mounting region of the base and an elongated body of the fastener of the second anchoring assembly that is at least partially received within the retaining member of the second anchoring assembly.

5. The portable basketball goal assembly as in claim 4, further comprising a first resilient member positioned between the head of the fastener of the first anchoring assembly and the upper surface of the first mounting region of the base and a second resilient member positioned between the head of the fastener of the second anchoring assembly and the upper surface of the second mounting region of the base.

6. The portable basketball goal assembly as in claim 1, wherein the first support strut is connected to the base proximate the first anchoring assembly and the second support strut is connected to the base proximate the second anchoring assembly.

7. The portable basketball goal assembly as in claim 1, wherein the first support strut is connected to the first anchoring assembly and the second support strut is connected to the second anchoring assembly.

8. The portable basketball goal assembly as in claim 1, further comprising a first bracket disposed between the fastener of the first anchoring assembly and the first mounting region of the base; and further comprising a second bracket disposed between the fastener of the second anchoring assembly and the second mounting region of the base.

9. The portable basketball goal assembly as in claim 8, wherein the first bracket includes rounded edges and a slot; and wherein the second bracket includes rounded edges and a slot.

10. The portable basketball goal assembly as in claim 1, wherein the first support strut is generally aligned with the first anchoring assembly and the second support strut is generally aligned with the second anchoring assembly.

11. The portable basketball goal assembly as in claim 1, further comprising a first bracket that connects the first support strut to the first anchoring assembly and a second bracket that connects the second support strut to the second anchoring assembly.

12. A portable basketball goal system that is capable of being selectively connected to a surface, the portable basketball goal system comprising:

an elongated support;

a basketball goal connected to the elongated support;

a base connected to the elongated support, the base including one or more wheels to facilitate movement of the portable basketball system, the base including a hollow space that is capable of being filled with a ballast material;

a first mounting region disposed along a first side of the base, the first mounting region including one or more openings;

a second mounting region disposed along a second side of the base, the second mounting region including one or more openings;

a first fastener extending through an opening of the one or more openings in the first mounting region of the base, the first fastener being connected to a first retaining member to selectively connect the portable basketball goal system to the surface; and a second fastener extending through an opening of the one or more openings in the second mounting region of the base, the second fastener being connected to a second retaining member to selectively connect the portable basketball goal system to the surface.

13. The portable basketball goal system as in claim 12, further comprising a first support strut including a first end connected to the elongated support and a second end connected to the first mounting region of the base, and a second support strut including a first end connected to the elongated support and a second end connected to the second mounting region of the base.

14. The portable basketball goal system as in claim 13, wherein the first strut is generally aligned with a portion of the first fastener and the second strut is generally aligned with a portion of the second fastener.

15. The portable basketball goal system as in claim 13, further comprising a first bracket that connects the first support strut to the first fastener and a second bracket that connects the second support strut to the second fastener.

16. The portable basketball goal system as in claim 13, further comprising an upper section of the base and a lower section of the base, a first portion of the upper section of the base abutting a first portion of the lower section of the base to form at least a part of the first mounting region of the base, and a second portion of the upper section of the base abutting a second portion of the lower section of the base to form at least a part of the second mounting region of the base.

17. The portable basketball goal assembly as in claim 13, wherein a portion of the upper section of the base is spaced apart from a portion of the lower section of the base to form a generally hollow interior portion that is capable of being filled with ballast.

18. A portable basketball goal system that is capable of being connected to a surface, the portable basketball goal system comprising:

an elongated support;

a basketball goal connected to the elongated support;

a base connected to the elongated support, the base including at least one wheel to facilitate movement of the portable basketball goal system;

a mounting region disposed in the base, the mounting region including one or more openings;

a support strut connected to the elongated support and the mounting region of the base;

an anchoring assembly at least partially disposed within the mounting region of the base, the anchoring assembly including a fastener that extends through at least one or the one or more openings in the mounting region, the fastener being connected to a retaining member to connect the portable basketball goal system to the surface.

19. The portable basketball goal system as in claim 18, further comprising a bracket at least partially disposed between the anchoring assembly and the mounting region.

20. The portable basketball goal system as in claim 18, further comprising a second mounting region disposed in the base, the second mounting region including one or more openings; a second support strut connected to the elongated support and the second mounting region of the base; and a second anchoring assembly at least partially disposed within the second mounting region of the base, the second anchoring assembly including a fastener that extends through at least one or the one or more openings in the second mounting region, the fastener being connected to a second retaining member to connect the portable basketball goal system to the surface.

21. The portable basketball goal system as in claim 18, wherein the support strut is generally aligned with a portion of the anchoring assembly.

22. The portable basketball goal system as in claim 18, further comprising a bracket that connects the support strut to the anchoring assembly.

23. The portable basketball goal assembly as in claim 18, further comprising an upper section of the base and a lower section of the base, a portion of the upper section of the base abutting a portion of the lower section of the base to form at least a part of the mounting region of the base.

24. The portable basketball goal assembly as in claim 23, wherein a portion of the upper section of the base is spaced apart from a portion of the lower section of the base to form a generally hollow interior portion that is capable of being filled with ballast.

25. A portable basketball goal system comprising:

a base;

an elongated support connected to the base;

a backboard and rim assembly connected to the elongated support and at least partially disposed above a playing surface;

a first mounting region formed in a first portion of the base;

a first support strut connecting the elongated support to the first mounting region of the base;

a first anchoring assembly at least partially disposed within the first mounting region, the first anchoring assembly including an anchor and an anchoring attachment, the anchor being attached to the anchoring attachment to secure the portable basketball goal system in the fixed position;

a second mounting region formed in a second portion of the base;

a second support strut connecting the elongated support to the second mounting region of the base; and a second anchoring assembly at least partially disposed within the second mounting region, the second anchoring assembly including an anchor and an anchoring attachment, the anchor being attached to the anchoring attachment to secure the portable basketball goal system in the fixed position.

26. The portable basketball goal system as in claim 25, wherein the first support strut is connected to the base proximate the first anchoring assembly and the second support strut is connected to the base proximate the second anchoring assembly.

27. The portable basketball goal system as in claim 25, wherein the first support strut is connected to the first anchoring assembly and the second support strut is connected to the second anchoring assembly.

28. The portable basketball goal system as in claim 25, wherein the anchor of the first anchoring assembly extends through an opening in the first mounting region of the base and the anchor of the second anchoring assembly extends through an opening in the second mounting region.

29. The portable basketball goal system as in claim 25, wherein the anchoring attachment of the first anchor assembly is connected to the playing surface and the anchoring attachment of the second anchor assembly is connected to the playing surface.

30. The portable basketball goal assembly as in claim 25, further comprising an upper section of the base and a lower section of the base, a first part of the upper section of the base abutting a first part of the lower section of the base to form at least a part of the first mounting region of the base, and a second part of the upper section of the base abutting a second part of the lower section of the base to form at least a part of the second mounting region of the base.

31. The portable basketball goal assembly as in claim 25, further comprising a bead of the anchor of the first anchoring assembly that is disposed proximate an upper surface of the first mounting region of the base and an elongated body of the anchor of the first anchoring assembly that is at least partially received within the anchoring attachment of the first anchoring assembly; and a head of the anchor of the second anchoring assembly that is disposed proximate an upper surface of the second mounting region of the base and an elongated body of the anchor of the second anchoring assembly that is at least partially received within the anchoring attachment of the second anchoring assembly.

32. The portable basketball goal assembly as in claim 25, further comprising a first resilient member positioned between the head of the anchor of the first anchoring assembly and the upper surface of the first mounting region of the base and a second resilient member positioned between the head of the anchor of the second anchoring assembly and the upper surface of the second mounting region of the base.

33. The portable basketball goal assembly as in claim 25, wherein the first support strut is connected to the first anchoring assembly and the second support strut is connected to the second anchoring assembly.

34. The portable basketball goal assembly as in claim 25, further comprising a first bracket disposed between the fastener of the first anchoring assembly and the first mounting region of the base; and further comprising a second bracket disposed between the fastener of the second anchoring assembly and the second mounting region of the base.

35. The portable basketball goal assembly as in claim 25, wherein the first bracket includes rounded edges and a slot; and wherein the second bracket includes rounded edges and a slot.

36. The portable basketball goal assembly as in claim 25, wherein the first support strut is generally aligned with the first anchoring assembly and the second support strut is generally aligned with the second anchoring assembly.

37. The portable basketball goal assembly as in claim 25, further comprising a first bracket that connects the first support strut to the first anchoring assembly and a second bracket that connects the second support strut to the second anchoring assembly.

* * * * *

UNITED STATES PATENT AND TRADEMARK OFFICE

CERTIFICATE OF CORRECTION

PATENT NO. : 6,776,734 B2
DATED : August 17, 2004
INVENTOR(S) : Edward G. van Nimwegen It is certified that error appears in the above-identified patent and that said Letters Patent is hereby corrected as shown below:

Column 1,
Line 25, after "Accordingly," insert -- it --

Column 5,
Line 36, after "playing surface" insert -- 20 --

Column 7,
Line 5, after "substantially" insert -- similar --

Column 8,
Line 34, change "12" to -- 112 --

Column 10,
Line 2, after "leaf springs" insert -- , --

Column 11,
Line 16, change "318" to -- 218 --
Lines 43 and 53, after "base" change "18" to -- 218 --
Line 57, before "through the bottom" change "case 18" to -- base 218 --

Column 12,
Line 50, change "318" to -- 218 --

Column 14,
Lines 30, 38, 43, 45, 47 and 50, after "attachment" change "480" to -- 380 --
Line 67, before "manually" remove "by"

UNITED STATES PATENT AND TRADEMARK OFFICE

CERTIFICATE OF CORRECTION

PATENT NO. : 6,776,734 B2
DATED : August 17, 2004
INVENTOR(S) : Edward G. van Nimwegen It is certified that error appears in the above-identified patent and that said Letters Patent is hereby corrected as shown below:

Column 20,
Line 17, change "bead" to -- head --

Signed and Sealed this

Fifth Day of April, 2005

JON W. DUDAS
*Director of the United States Patent and Trademark Office*